US005560420A

United States Patent [19]

Hansen et al.

[11] Patent Number: 5,560,420

[45] Date of Patent: Oct. 1, 1996

[54] PROCESS FOR CASTING HARD-FACED, LIGHTWEIGHT CAMSHAFTS AND OTHER CYLINDRICAL PRODUCTS

[75] Inventors: Jeffrey S. Hansen, Corvallis; Paul C. Turner; Edward R. Argetsinger, both of Albany; Rick D. Wilson, Corvallis, all of Oreg.

[73] Assignee: The United States of America as represented by the Secretary of the Interior, Washington, D.C.

[21] Appl. No.: 348,932

[22] Filed: Nov. 25, 1994

[51] Int. Cl.[6] ..... B22D 13/00; B22D 19/14; B22C 9/02

[52] U.S. Cl. ..... 164/114; 164/97; 164/34

[58] Field of Search ..... 164/114, 115, 164/97, 34, 35

[56] References Cited

U.S. PATENT DOCUMENTS

| | | | |
|---|---|---|---|
| 5,052,464 | 10/1991 | Natori | 164/97 |
| 5,083,602 | 1/1992 | Skibo | 164/97 |
| 5,372,176 | 12/1994 | Brown et al. | 164/34 |

FOREIGN PATENT DOCUMENTS

| | | | |
|---|---|---|---|
| 58-116970 | 7/1983 | Japan | 164/114 |

*Primary Examiner*—Jack W. Lavinder
*Assistant Examiner*—I. H. Lin
*Attorney, Agent, or Firm*—E. Philip Koltos

[57] ABSTRACT

A process for casting a hard-faced cylindrical product such as an automobile camshaft includes the steps of: (a) preparing a composition formed from a molten base metal and an additive in particle form and having a hardness value greater than the hardness value of the base metal; (b) introducing the composition into a flask containing a meltable pattern of a cylindrical product such as an automobile camshaft to be manufactured and encased in sand to allow the composition to melt the pattern and assume the shape of the pattern within the sand; and (c) rotating the flask containing the pattern about the longitudinal axes of both the flask and the pattern as the molten base metal containing the additive in particle form is introduced into the flask to cause particles of the additive entrained in the molten base metal to migrate by centrifugal action to the radial extremities of the pattern and thereby provide a cylindrical product having a hardness value greater at it's radial extremities than at its center when the molten base metal solidifies.

11 Claims, 1 Drawing Sheet

PROCESS FOR CASTING HARD-FACED, LIGHTWEIGHT CAMSHAFTS AND OTHER CYLINDRICAL PRODUCTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates generally to a process for casting a cylindrical product and, more particularly, to such a casting process which, when implemented, provides a cylindrical product having a wear-resistant outer surface at its radial extremities.

2. Description of the Prior Art

National transportation objectives include the conservation of fuel by increasing the efficiency of automobiles and reducing toxic airborne automobile emissions. Suggested ways to improve internal combustion engine efficiency are to downsize the overall weight of automobiles and to reduce the mass of rotating engine parts such as camshafts to minimize the energy that is expended to overcome friction and rotational inertia.

Presently, most camshafts are made of iron or steel by forging or casting, using conventional forging or casting techniques. As is well known in the art, iron or steel camshafts perform the job of opening and closing valves through millions of cycles and rarely require replacement. Thus, reliability, maintenance and the general performance of conventional automobile camshafts are not concerns. However, it is well recognized that iron or steel camshafts greatly increase overall engine weight.

In order to downsize the overall weight of automobiles and reduce the mass of various rotating engine parts, lighter-weight camshafts have been proposed. One proposal utilizes powder metallurgy (PM) cams and a tubular steel shaft. The shaft is inserted through holes in the cams. After positioning the cams for proper alignment, a mandrel is passed through the shaft and expanded to press fit and lock the cams to the shaft. Afterward, the mandrel is relaxed and removed. Other conventional materials have been suggested for use in the manufacture of automobile camshafts to reduce their weight. For example, the use of magnesium and aluminum have been proposed. However, while economically feasible on a first-cost basis, neither of these materials possess, in their pure form, the inherent strength, durability and wear resistance required for sustained performance and are not acceptable without some form of alteration.

With the knowledge of the inherent weakness of pure aluminum in mind, lighter weight automobile camshafts have been made utilizing aluminum that contains added strengtheners such as particles and fibers. Unfortunately, these aluminum additions to increase wear resistance utilizing presently known addition processes have not been successful. Neither have efforts to increase the wear resistance of aluminum via surface treatment techniques been successful due to the costs associated with implementing these techniques.

As can been seen from the foregoing, efforts to reduce the weight of automobile engine parts such as camshafts utilizing light weight metals like pure magnesium and aluminum to increase the efficiency of automobile engines have met with little success. Consequently, there is a need for an improved process for manufacturing automobile camshafts which may be implemented using light weight metals such as magnesium and aluminum to reduce camshaft weight. This improved process must be capable of imparting to the camshaft the strength, durability and wear resistance qualities necessary to allow an aluminum or magnesium camshaft to sustain the millions of operating cycles seen in conventional automobile engines without failure.

SUMMARY OF THE INVENTION

The present invention relates to a process for casting a hard-faced cylindrical product such as an automobile camshaft designed to satisfy the aforementioned needs. The process of the present invention allows a light weight metal such as magnesium or aluminum to be used as the base metal for the cylindrical product. Implementation of the process results in the creation of wear-resistant surfaces at the radial extremities of the cylindrical product coincidentally during part casting by utilizing centrifugal force to concentrate wear resistant particles entrained in the cast base metal at the products's radial extremities.

Accordingly, the present invention is directed to a process for casting a hard-faced cylindrical product. The process includes the steps of: (a) preparing a composition formed from a molten base metal and an additive in particle form having a hardness value greater than the hardness value of the base metal; (b) introducing the composition into a flask containing a meltable pattern of a cylindrical product to be manufactured and encased in sand to allow the composition to melt the pattern and assume the shape of the pattern within the sand; and (c) rotating the flask about an axis extending longitudinally through the center of the pattern and through the center of the flask as the composition is introduced into the flask to cause particles of the additive entrained in the molten base metal to migrate by centrifugal action to the radial extremities of the pattern and thereby provide a cylindrical product having a hardness value greater at it's radial extremities than at its center when the molten base metal solidifies within the sand.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

The present invention is directed to a process for casting a hard-faced cylindrical product such as an automobile camshaft from a light weight base metal such as aluminum or magnesium. Implementation of the process of the present invention provides an elongated product with cylindrical surfaces such as an automobile camshaft having improved stiffness at the radial extremities of the camshaft and improved wear resistance properties at these same radial extremities. The increases in stiffness and wear resistance are achieved by concentrating hard particles such as silicon carbide (SIC) particles at these locations. Other hard particles such as cermet and ceramic particles may also be employed with similar results.

Generally, the process of the present invention includes the following steps of:

(a) preparing a composition formed from a molten base metal such as aluminum or magnesium and a hard particle additive such as SiC particles, cermet particles or ceramic particles having a hardness value greater than the hardness value of the base metal;

(b) introducing the composition into a casting flask containing a meltable pattern of a cylindrical product such as an automobile camshaft to be manufactured and encased in sand to allow the composition to melt the pattern and assume the shape of the pattern within the sand; and (c) rotating the flask containing the pattern about the longitudinal axes of both the flask and the pattern as the molten base metal containing the additive in particle form is introduced into the flask to cause particles of the additive entrained in the molten base metal to migrate by centrifugal action to the radial extremities of the pattern and thereby provide a cylindrical product such as an automobile camshaft having a hardness value greater at it's radial extremities than at its center when the molten base metal solidifies.

As stated, the migration of the hard particles occurs due to centrifugal action and because of the fact that the hard particles have a density greater than the density of the base metal. For example, if the base metal utilized in the process of the present invention is pure aluminum and the hard particles are SiC, the SiC particles have a density of 3.2 g/cc and the aluminum has a density of 2.7 g/cc. Since the density of the SiC is greater than the density of the aluminum, the centrifuging of the SiC particles to the radial extremities of the camshaft is done coincidentally with the rotation of the flask. The SiC particles located at the radial extremities of the camshaft increase both the stiffness and wear resistance of the camshaft at these radial locations.

EXAMPLE

Figure 1:
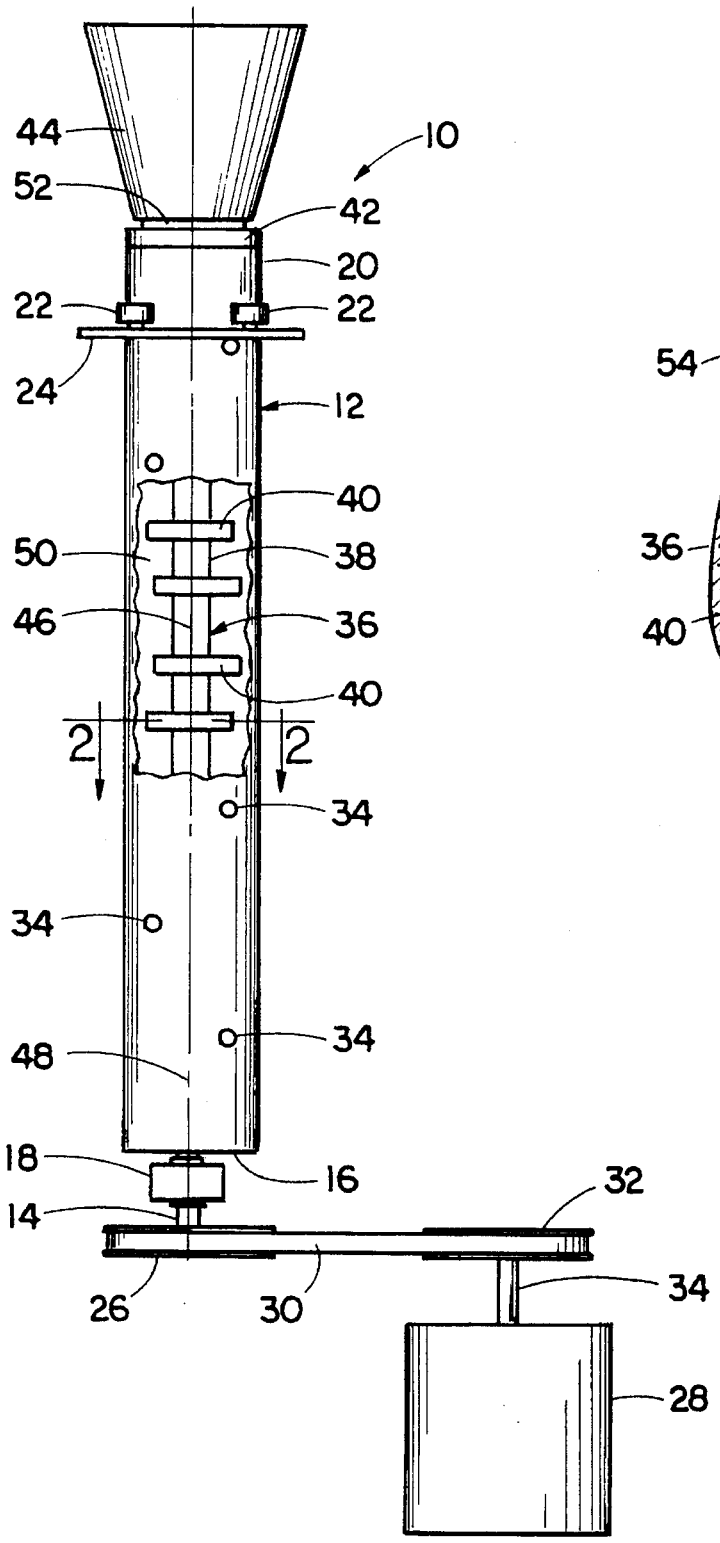
FIG. 1 is a partially cutaway view in side elevation of a casting apparatus utilized to implement the process of the present invention for casting a hard-faced cylindrical product.

A centrifugal casting apparatus for implementing the process of the present invention is illustrated in FIG. 1. The centrifugal casting apparatus of FIG. 1 was made to test the process of the present invention and was tailored specifically to making camshafts. Camshaft patterns representing no particular commercial prototype were made and utilized within the casting apparatus to simulate a real four-cylinder camshaft. As seen in FIG. 1, the centrifugal casting apparatus is generally designated by the numeral 10 and includes a vertically oriented three-inch ID steel tube or flask 12 approximately two feet long. A one-half inch shaft 14 is secured via welding to the bottom 16 of the flask 12 for insertion through a thrust bearing 18 which serves as the lower support for the casting apparatus 10. The top 20 of the flask 12 is maintained in place by three rollers 22 (only two shown) placed 120 degrees apart. The rollers are fastened to an adjustable plate 24 to allow positioning and removal of the flask 12 from the apparatus 10. A pulley 26 is attached to the one-half inch shaft 14, and a drive motor 28 is used to rotate the flask 12 by means of a drive belt 30 extending between the pulley 26 and a drive pulley 32 connected to the output shaft 34 of the motor 28.

The flask 12 is drilled with numerous ⅜ inch diameter holes 34 to allow the escape of gasses during the casting of molten metal into the flask 12. A 120 mesh stainless steel screen (not shown) covers the holes 34 and is positioned within the interior of the flask 12 to prevent sand located within the flask 12 to pass through the holes 34 during rotation of the flask 12. However, the 120 mesh allows gasses to escape through the holes 34 as molten metal is introduced into the interior of the flask 12.

A polystyrene pattern 36 of a four-cylinder engine camshaft is made taking care to keep glued joints to a minimum. The shaft 38 and lobes 40 of the pattern 36 are made separately and assembled, relying on interference fits to achieve positioning. The center of the shaft 38 is hollowed out to promote faster filling when the molten base metal is poured into the flask 12. The centrifugal casting apparatus 10 also includes a graphite lid 42 for the top 20 of the flask 12 and a split graphite funnel 44. The graphite lid 42 contains a hole through its center through which the aluminum base metal passes during casting. The pattern 36 is located in the center of the flask 12 by shimming it from the inside wall of the tube. This also insures that the pattern 36 is straight and that the longitudinal centerline 46 of the pattern 36 is aligned with the longitudinal centerline 48 of the flask 12.

Number 3050 silica sand (sand illustrated generally at 50) is rained in around the pattern 36 and compacted by vibrating the flask 12. The shims are then removed when the sand 50 and pattern 36 are packed in place. After the pattern 36 is packed in the sand 50, the graphite lid 42 is placed on the top 20 of the flask 12. The flask 12 is then inserted into the casting apparatus 10. The graphite funnel 44 is secured over the top 20 of the flask 12 and remains stationary during casting. A graphite felt washer 52 is located between the funnel 44 and the lid 42 to prevent molten aluminum from passing between the funnel 44 and the lid 42 during casting and interfering with the rotation of the flask 12.

Duralcan 356 aluminum with 20% SiC (produced by Duralcan USA) is next melted in an induction furnace in a clay graphite crucible to produce a homogeneous molten composition with the SiC particles being evenly and uniformly distributed throughout the molten aluminum. No additives are made to the melt other than the addition of the SiC. It has been found that up to 20 volume percent SiC may be added to the molten aluminum with satisfactory results. To lessen the chances of freezing metal stopping rotation of the flask 12, only enough aluminum was poured to fill the pattern 36. The graphite funnel 44 is heated to approximately 250 degrees C. prior to casting to lessen heat loss and increase the time during which the aluminum is molten, thus allowing a maximum period for centrifuging of the SiC particles. The flask 12 is rotated at 1850 rpm by operation of the motor 28. Molten aluminum containing SiC particles is poured at about 750 degrees C. Rotation is successfully continued for about a minute after the pour is completed.

EXPERIMENTAL RESULTS

Figure 2:
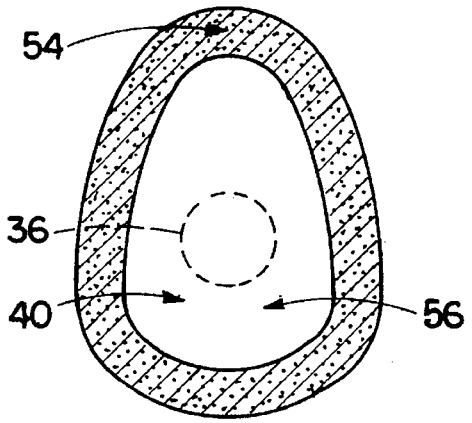
FIG. 2 is a sectional view of an automobile camshaft lobe taken along line 2—2 of FIG. 1 and formed utilizing the process of the present invention.

A full camshaft weighing about 1500 g was removed from the flask 12 and cooled with water. The shaft 38 of the camshaft was sectioned at every other lobe 40 starting at the bottom as it was located in the flask 12. A representative cross-sectional illustration of one of the lobes 40 is illustrated in FIG. 2. Microscopic observation artistically represented in FIG. 2 confirmed that centrifuging of all SiC particles to the outside or radial extremities of the lobes 40 was complete (radial extremity of the lobe 40 represented by the numeral 54) and that the material in the lighter colored inner portion 56 of the lobe 40 was free from SiC particles.

Dry sand-rubber wheel abrasion tests were performed on a SiC-containing aluminum surface made utilizing the process of the present invention according to ASTM G-65, procedure B. The results of SiC-surfaced aluminum showed volume losses of 36.1 $mm^3$ and 31.9 $mm^3$. By way of comparison, annealed 1020 steel lost 132.8 $mm^3$, 1018 steel lost 129.1 $mm^3$, water quenched 1080 steel lost 29.1 $mm^3$, water quenched 4340 steel lost 42.4 $mm^3$ and water quenched 5160 steel lost 39.6 $mm^3$. Aluminum without SiC embedded utilizing the process of the present invention lost 578 $mm^3$.

Permanent mold casting methods for achieving the same objective, i.e., separation of SiC to the outside surfaces or radial extremities of a camshaft, were also tried. Tighter tolerances are possible with permanent molds, and the product requires less machining and finishing. In addition, a permanent mold can be heated to retard cooling from the cast alloy liquid and thereby provide additional time for SiC particle separation and consolidation to the outside of the shaft. However, because a four-cylinder camshaft contains reverse reentrant angles on some of the cam lobes, a permanent mold for a four cylinder or larger engine can not be made in two halves. A complex multiple component die with several withdrawing mechanisms is necessary. The investment in such a die might be economical if production runs were sufficiently long.

As described herein, the centrifugal casting process of the present invention provides a means for significantly increasing the wear resistance of wear-prone surfaces of camshafts utilizing SiC or other hard particles. The SiC particles also serve to selectively strengthen the outside fibers of the shaft. The inclusion of SiC in aluminum allows the use of pure aluminum or magnesium as a base metal for automobile camshaft applications and results in a reduction in the overall weight of the engine in which it is used.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the form hereinbefore described being merely a preferred or exemplary embodiment thereof.

We claim:

1. A process for casting an elongated hard-faced product having cylindrical surfaces, such as an automobile camshaft, comprising the steps of:

(a) preparing a homogeneous molten composition formed from a molten base metal and an additive in particle form having a hardness value greater than the hardness value of said base metal, said homogeneous molten composition having said particle additive evenly and uniformly distributed throughout said molten base metal;

(b) introducing said homogeneous molten composition into an upper end of a vertically extending flask containing a meltable pattern of an elongated product having cylindrical surfaces to be manufactured and encased in sand whereupon said composition melts said pattern and assumes the shape of said pattern within said sand, said meltable pattern having a central elongated cavity extending from an upper end to a lower end thereof such that said homogeneous molten composition fills said pattern from its lower end to its upper end as said homogeneous molten composition is introduced into the upper end of said flask; and (c) rotating said vertically extending flask and said pattern along therewith about a vertical axis extending longitudinally through the center of said pattern and through the center of said flask as said homogeneous molten composition is introduced into said flask and passes down through said central cavity to melt away and fill said pattern from its lower end to its upper end in thereby causing particles of said additive entrained in said molten base metal of said homogeneous molten composition to migrate by centrifugal action to the radial extremities of said pattern and thereby provide the cylindrical surfaces of said elongated product with a hardness value greater than the hardness value of the center of said product when said homogeneous molten composition solidifies within said sand.

2. The process as recited in claim 1, wherein said pattern is positioned within said flask so that said axis extending longitudinally through the center of said pattern coincides with said axis extending longitudinally through the center of said flask.

3. The process as recited in claim 1, wherein said base metal is aluminum.

4. The process as recited in claim 1, wherein said base metal is magnesium.

5. The process as recited in claim 1, wherein said additive is formed from particles of a cermet material.

6. The process as recited in claim 1, wherein said additive is formed from particles of a ceramic material.

7. The process as recited in claim 1, wherein said additive is silicon carbide.

8. The process as recited in claim 1, wherein said additive forms up to 20 volume percent of said composition.

9. The process as recited in claim 1, wherein said additive has a density greater than the density of said base metal.

10. The process as recited in claim 1, wherein said meltable pattern is made from polystyrene.

11. The process as recited in claim 1, wherein said flask is provided with a plurality of holes for the escape of gases generated during the casting process.

* * * * *